US005628152A

United States Patent [19]

Bowman

[11] Patent Number: 5,628,152

[45] Date of Patent: May 13, 1997

[54] ADJUSTABLE MANHOLE COVER SUPPORT WITH SHIELD

[76] Inventor: Harold M. Bowman, 18867 N. Valley Dr., Fairview Park, Ohio 44126

[21] Appl. No.: 515,986

[22] Filed: Aug. 16, 1995

[51] Int. Cl.[6] ..... E02D 29/14

[52] U.S. Cl. ..... 52/20; 404/25; 404/26; 137/371; 137/364; 210/163

[58] Field of Search ..... 52/19, 20, 21; 404/25, 26; 137/371, 364; 210/163, 165; D23/261

[56] References Cited

U.S. PATENT DOCUMENTS

| | | |
|---|---|---|
| Re. 34,550 | 2/1994 | Bowman . |
| D. 247,254 | 2/1978 | Brown et al. . |
| 911,256 | 2/1909 | McWane . |
| 922,892 | 5/1909 | Harrington . |
| 953,858 | 4/1910 | Rice et al. . |
| 1,001,041 | 8/1911 | Jones . |
| 1,016,081 | 1/1912 | McNulty . |
| 1,071,577 | 8/1913 | Rego . |
| 1,073,150 | 9/1913 | Linskie . |
| 1,102,422 | 7/1914 | McKeon . |
| 1,131,327 | 3/1915 | Caldwell . |
| 1,152,618 | 9/1915 | Farris . |
| 1,163,189 | 12/1915 | Wolf . |
| 1,177,850 | 4/1916 | Dougherty . |
| 1,191,431 | 7/1916 | Jones . |
| 1,191,432 | 7/1916 | Jones . |
| 1,191,497 | 7/1916 | Dauphinee . |
| 1,287,290 | 12/1918 | Golden . |
| 1,384,712 | 7/1921 | Shanley . |
| 1,388,492 | 8/1921 | Thomsen . |
| 1,400,399 | 12/1921 | Yaeche . |
| 1,417,377 | 5/1922 | Gschwind . |
| 1,542,900 | 6/1925 | Maddocks . |
| 1,602,713 | 10/1926 | Shanley . |
| 1,610,123 | 12/1926 | Fairweather . |
| 1,639,495 | 8/1927 | Frame . |
| 1,683,365 | 9/1928 | Loudenslager et al. . |

(List continued on next page.)

FOREIGN PATENT DOCUMENTS

| | | | |
|---|---|---|---|
| 483018 | 5/1952 | Canada | 210/165 |
| 1965515 | 10/1970 | Germany | 52/20 |
| 336437 | 11/1930 | United Kingdom . | |
| 2066335 | 7/1981 | United Kingdom | 52/20 |
| 2088446 | 6/1982 | United Kingdom | 52/20 |

OTHER PUBLICATIONS

Drawing from New York State's Department of Transportation, Published before Aug. 16, 1994.

P.C. Perdikaris, P.E., Ph.D., Technical Civil Engineering Report, Mar. 15, 1988.

Nupco brochure, "Adjus–To–Grade With Safe–Tite Seal", copyright 1989.

Grate Locking Device brochure. Published before Aug. 16, 1994. Author unknown.

Japanese publication entitled "Reinforced Concrete Man Hole Blocks For Sewage Work", by Japanese Standards Association, published 1990.

Japanese Publication entitled "Man Hole Cover For Sewage", by Japanese Standards Association, published 1987.

Specification sheets and drawings from Taiwanese distributor, 4 pages, date unknown.

*Primary Examiner*—Carl D. Friedman
*Assistant Examiner*—Aimee E. McTigue
*Attorney, Agent, or Firm*—Watts, Hoffmann, Fisher & Heinke

[57] ABSTRACT

A manhole cover and frame assembly includes an outer frame having a support surface and a side wall that extends upward from the support surface and has a recessed portion. An inner frame is supportable on the support surface. The inner frame has a protrusion extending from the outer peripheral surface. The inner frame also includes an adjustable joint for adjusting the inner frame in its peripheral dimensions to expand to engage the protrusion with the recessed portion, thereby preventing upward movement of the inner frame, and to contract to remove the protrusion from the recessed portion. The inner frame also includes a cover support surface. A manhole cover is supportable on the cover support surface.

21 Claims, 5 Drawing Sheets

U.S. PATENT DOCUMENTS 1,693,190 11/1928 Benedetti .
1,717,364 6/1929 Borland .
1,721,831 7/1929 Porter .
1,892,830 1/1933 Dougherty .
1,898,871 2/1933 Ellis .
1,926,595 9/1933 Mulvihill .
1,926,881 6/1933 Shanley .
1,959,171 5/1934 Mayer .
1,988,360 1/1935 Moore .
2,009,132 7/1935 Gehris .
2,051,172 8/1936 Kramer .
2,109,287 2/1938 Elkington .
2,113,713 4/1938 Slocum .
2,114,499 4/1938 Maclear .
2,535,275 12/1950 Dixon .
2,682,211 6/1954 Avila .
2,817,274 12/1957 Benoit .
2,967,389 12/1961 Heckman .
3,217,619 11/1965 Driver et al. .
3,218,943 11/1965 Bowman .
3,292,494 12/1966 Coe .
3,408,778 11/1968 Mason .
3,426,659 2/1969 Clarke et al. .
3,773,428 11/1973 Bowman .
3,858,998 1/1975 Larson et al. .
3,891,337 6/1975 McCoy .
3,920,347 11/1975 Sauriol et al. .
3,926,533 12/1975 Binette .
3,930,739 1/1976 Larsson et al. .
3,945,746 3/1976 Bredbenner .
3,968,600 7/1976 Bowman .
3,969,847 7/1976 Campgagna et al. .
3,973,856 8/1976 Gaglioti .
3,975,870 8/1976 Naka ..... 52/20
3,977,124 8/1976 Oger .
4,000,953 1/1977 Langeliers et al. .
4,015,373 4/1977 Boissier .
4,029,425 6/1977 Peisue .
4,030,851 6/1977 Graybeal .
4,038,789 8/1977 Axgarde et al. .
4,061,434 12/1977 Carroll .
4,067,659 1/1978 Campagna et al. .
4,075,796 2/1978 Cuozzo .
4,089,139 5/1978 Motta et al. .
4,097,228 6/1978 Rosling .
4,123,184 10/1978 Whitlock .
4,145,151 3/1979 Helms .
4,187,647 2/1980 Hall .
4,188,151 2/1980 Hall .
4,197,031 4/1980 Hild .
4,203,686 5/1980 Bowman .
4,236,358 12/1980 Bowman .
4,269,385 5/1981 Bowman .
4,273,467 6/1981 Cronk .
4,281,944 8/1981 Bowman .
4,358,084 11/1982 Bowman .
4,416,440 11/1983 Bowman .
4,440,407 4/1984 Gagas .
4,582,449 4/1986 Vosswinkel .
4,582,450 4/1986 Neil .
4,637,752 1/1987 Centa .
4,649,674 3/1987 Gaul et al. ..... 210/165 X
4,650,365 3/1987 Runnels .
4,690,584 9/1987 LeBaron ..... 404/26
4,747,739 5/1988 Bowman .
4,763,449 8/1988 Vigneron et al. .
4,834,574 5/1989 Bowman .
4,867,600 9/1989 Bowman .
4,867,601 9/1989 Bowman .
4,872,780 10/1989 Bowman .
4,927,290 5/1990 Bowman .
4,963,053 10/1990 Bowman .
4,966,489 10/1990 Bowman .
4,969,770 11/1990 Bowman .
4,969,771 11/1990 Bowman .
4,976,568 12/1990 Hess ..... 52/20 X
5,021,261 6/1991 Bowman .
5,039,248 8/1991 Bowman .
5,051,022 9/1991 Bowman .
5,143,478 9/1992 Bowman .
5,150,984 9/1992 Bowman .
5,165,819 11/1992 Bowman .
5,184,912 2/1993 Bowman .
5,201,151 4/1993 LeBlanc et al. ..... 52/21 X
5,303,518 4/1994 Strickland ..... 52/21
5,308,189 5/1994 Claing ..... 404/26
5,326,188 7/1994 Bowman .
5,344,253 9/1994 Sacchetti ..... 52/21 X
5,366,317 11/1994 Solimar ..... 52/20 X
5,383,311 1/1995 Strickland ..... 52/20
5,401,114 3/1995 Guggemos ..... 52/20 X
5,431,553 7/1995 Topf, Jr. ..... 404/25 X

ADJUSTABLE MANHOLE COVER SUPPORT WITH SHIELD

BACKGROUND OF THE INVENTION

This invention relates to manhole cover and frame assemblies and, in particular, to an inner frame member or insert for raising the level of a manhole cover upon resurfacing a roadway.

Manhole cover and frame assemblies located along a roadway typically include an outer frame having a seat on which a manhole cover rests flush with the roadway surface. Ordinarily, a manhole cover support insert is used when the roadway is resurfaced with an added layer of paving material. The support insert raises the level of the manhole cover to the new street level. Support inserts typically occupy the seat where the manhole cover was intended to rest in the outer frame. Manhole frame and cover assemblies may be provided with a locking mechanism to prevent unauthorized personnel from removing the cover.

Manhole assemblies are currently unable to satisfactorily prevent "inflow", a combination of storm water and other street surface liquids, from entering an access opening of the outer frame. This inflow may consist of billions upon billions of gallons of excess street surface liquids. Once the inflow enters the manhole frame it gains entry into utility services such as sanitary sewer distribution lines, where it burdens wastewater treatment plants, and gas, electric or telecommunications underground vaults. The inflow is a problem because it mixes with the effluent in sanitary sewers, resulting in costly additional wastewater treatment.

An additional problem is presented when the inflow reaches other utility service areas normally found in gas, electric or telecommunications distribution lines. These service areas have concrete manhole casements that do not have an individual drainage system, and thus are partially or completely filled with inflow. Such installations often require extensive vacuum pumping to remove the inflow before workmen can safely enter the manhole to perform the required maintenance or other utility service.

Manhole frame and cover casting assemblies are normally comprised of metal castings, generally produced by cast iron foundries, using sand casting molds. These casting methods are used to produce manhole components in cast ductile iron, grey cast iron, or the like. Castings made from these casting processes create difficulties in duplicating nearly exact castings as compared to the mold images. Non-uniform shrinkage, warpage, and the like promote dimensional instability that affects the fit between metal surfaces necessary to provide a water-tight condition.

SUMMARY OF THE INVENTION

The present invention relates to manhole cover and frame assemblies that overcome the aforementioned problems of the prior art. The present manhole cover and frame assemblies are suitable for raising the level of a manhole cover to the level of a repaved roadway, reduce security risks of unauthorized removal of the manhole covers, and reduce the problems of inflow.

A manhole cover and frame assembly of the invention includes an outer frame member having a support surface and a side wall extending upward from the support surface and having a recessed portion. An inner frame member is supportable on the outer frame support surface. The inner frame member includes a cover support surface. A manhole cover is supportable on the cover support surface.

The inner frame member has at least one adjustable joint for adjusting the inner frame in its peripheral dimensions. The inner frame member has at least one protrusion that extends from and beyond the outer peripheral wall surface, thereby being expandably engageable with at least a portion of the recessed opening in the outer frame sufficient to prevent upward movement of the inner frame member.

The inner frame member may also be comprised of segments that are expandable to provide greater and more accurate peripheral adjustment in the circumferential contact with the recessed portion of the outer frame. The inner frame member can be comprised of a segmented ring having at least one adjustable joint for adjusting the peripheral dimensions in order to move the protrusion of the inner frame member.

In a preferred embodiment, an adjustable member connects adjacent segments and is constructed to cause the inner frame member to expand to move each protrusion into the recessed portion, thereby preventing upward movement of the inner frame member, and to contract to remove the protrusion from the recessed portion. Four segments have adjustable members that can cause the outwardly extending protrusions existing in each section to engage the recessed portions in the outer frame.

In the preferred and illustrated embodiment, a water-tight seal is also provided to fit into the space or spaces existing between the openings in the inner frame after installation. A molded portion or a portion of an extruded member cut to fit, can be heated or chemically bonded in place to keep the inner frame water-tight. These portions also identify the placement of the adjustable members.

In a more preferred embodiment, the manhole cover and frame assembly of the invention includes a fastener connecting the cover to the inner frame. A seal is provided between the inner and outer frame members and inhibits fluids from passing therebetween. A fluid shield member can be positioned below the cover for catching fluid passing the cover. A lower support surface is located below the support surface and extends laterally from the outer frame member. The shield member is supportable on the lower support surface.

One embodiment of the fluid shield member of the invention includes a central hub having a passage therethrough and a lower base portion. A portion extends laterally from the base portion to the lower support surface. The outer configuration of the central hub has a narrowing taper upward from the lower base portion. The lateral portion is sloped downward from its outer periphery to the central hub. The configuration of the fluid shield member prevents fluids passing the cover from entering the utility service. The fluid shield member may be fastened to the lower support surface.

In one preferred embodiment, the shield member has a central opening. An apparatus for connecting the shield member to the outer frame member includes a flexible member that can be disposed in a peripheral groove formed in the outer frame member above the lower support surface. A plunger member is axially movable in the central opening and connected to the flexible member for sealingly engaging the flexible member in the peripheral groove. The plunger member includes a stop member that can limit the axial movement of the plunger. The flexible member normally has an accordion-like cross-sectional shape, which is flattened when the flexible member is depressed by the plunger.

In another preferred embodiment, the manhole cover and frame assembly includes an outer frame member having a support surface and a side wall extending upward from the support surface and having a recessed portion. A manhole cover is also provided. An inner frame member supportable on the support surface of the outer frame includes a lower surface, an outer peripheral surface, and a support surface for supporting the cover. At least one of the segments has undercut portions at the lower surface, and a protrusion extends from the outer peripheral surface. An adjustable member connects adjacent segments and is constructed to cause the inner frame member to expand to move each protrusion into the recessed portion, thereby preventing upward movement of the inner frame member, and to contract to disengage the protrusion from the recessed portion.

In this preferred embodiment, an apparatus for connecting the cover to the inner frame member includes rotatable locking devices each having a locking member with a heel portion and a toe portion for engaging the undercut portions. Each locking member has a threaded portion defining a hole therein. Lock housings are each connected to the cover and have a vertical opening therein. Threaded shafts are provided that extend through an associated lock housing opening and are threaded to an associated locking member. Each of the shafts has a head portion for permitting the shaft to be rotated. Stop surfaces are provided for stopping rotation of the locking member at a predetermined position. Rotation of each shaft head portion causes the associated locking member to rotate until the toe portion extends into one of the undercut portions of the inner frame member at a stopping point where the locking member engages the stop surface. Further rotation of the shaft drives the locking member upward toward the housing to clamp the cover to the inner frame member.

The manhole cover and frame assemblies of the present invention substantially reduce the inflow problems of the prior art. The entire inner frame member is preferably covered with a sealant material. The seal provided between the inner and outer frame members prevents inflow from passing therebetween. Also, the action of clamping the cover to the inner frame member provides a seal therebetween. In addition, the sealing portions between segments of the inner frame member prevent inflow from passing through the inner frame segment openings.

Finally, should any fluid pass the cover it is caught by the fluid shield, which inhibits it from entering the utility service. The fluid shield also inhibits odors in sewer distribution lines from entering the atmosphere. The sealing qualities of the fluid shield also inhibits atmospheric oxygen from entering the sanitary sewer distribution lines and reacting with hydrogen sulfide to create sulfuric acid.

The fluid shield is preferably provided with an opening that releases pressure in the utility service. The opening allows some inflow above the fluid shield to enter the utility service so that in the event of heavy rain or flooding, the manhole cover is not pushed upward by such inflow.

In addition to providing seals that overcome the problems of inflow, the locking device of the present invention prevents unauthorized personnel from removing the manhole cover. All aspects of the present invention are suitable for modifying original manhole cover and frame assemblies when the level of the roadway is raised. In the event of repaving of the roadway to a higher level, an inner frame member having longer side walls and a higher cover support surface is selected so that the cover is flush with the repaved roadway.

The present invention addresses the fit between metal surfaces necessary to provide a water-tight condition as a result of production of metal castings by cast iron foundries using sand casting molds. In this regard, the present invention uses natural rubber seals or other like material which compensates for much of the tolerance variations. The invention combines the use of such seals with an expansive force that compressively seals the matching inseam surfaces of the engaged component parts and assembles that could otherwise allow the entry of stormwater and other street surface liquids into the utility service.

The invention will become better understood from the accompanying drawings and detailed description of the preferred embodiments.

DESCRIPTION OF PREFERRED EMBODIMENTS

Figure 1:
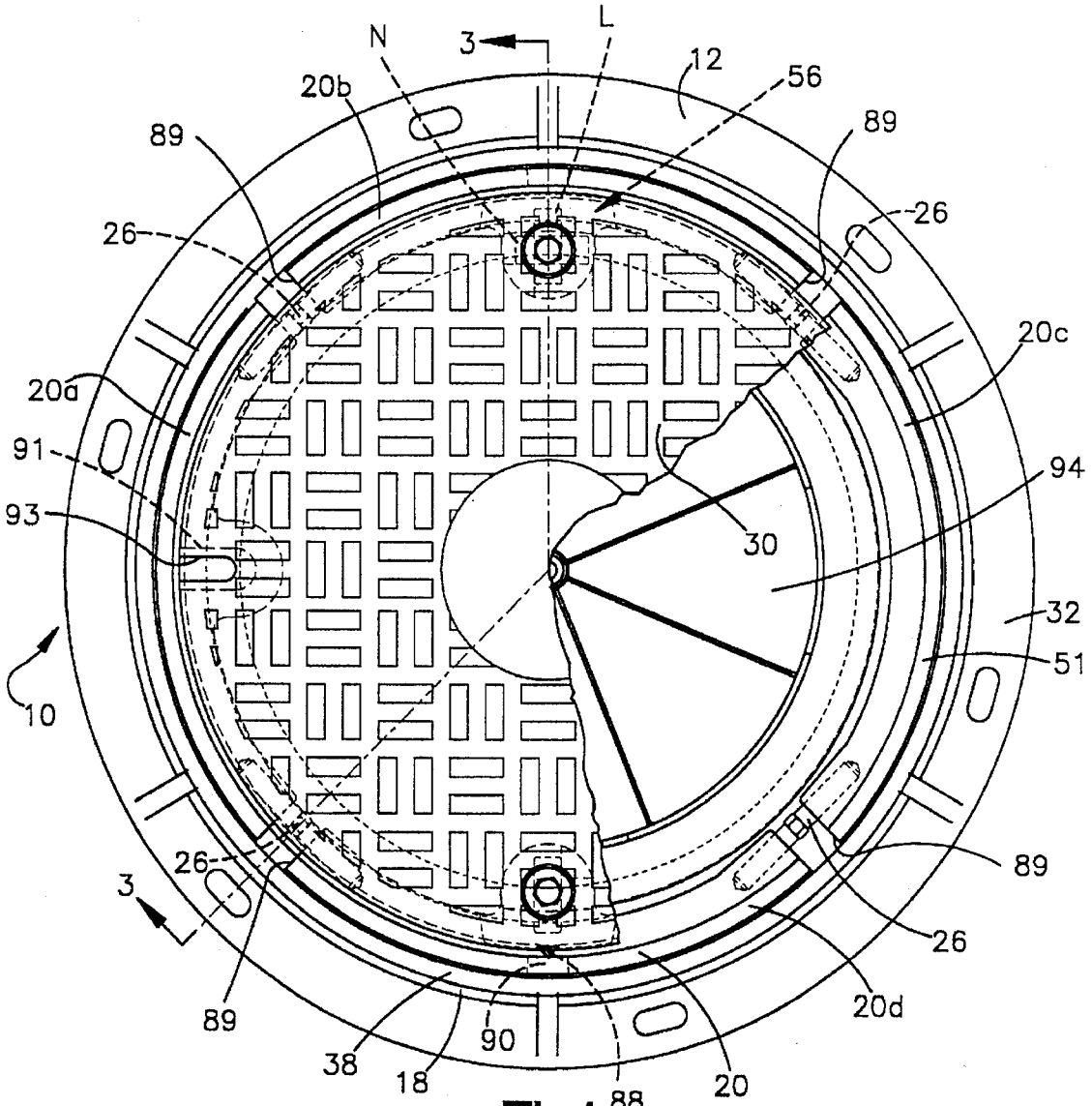
FIG. 1 is a top plan view of a manhole cover and frame assembly constructed in accordance with the present invention.
Figure 3:
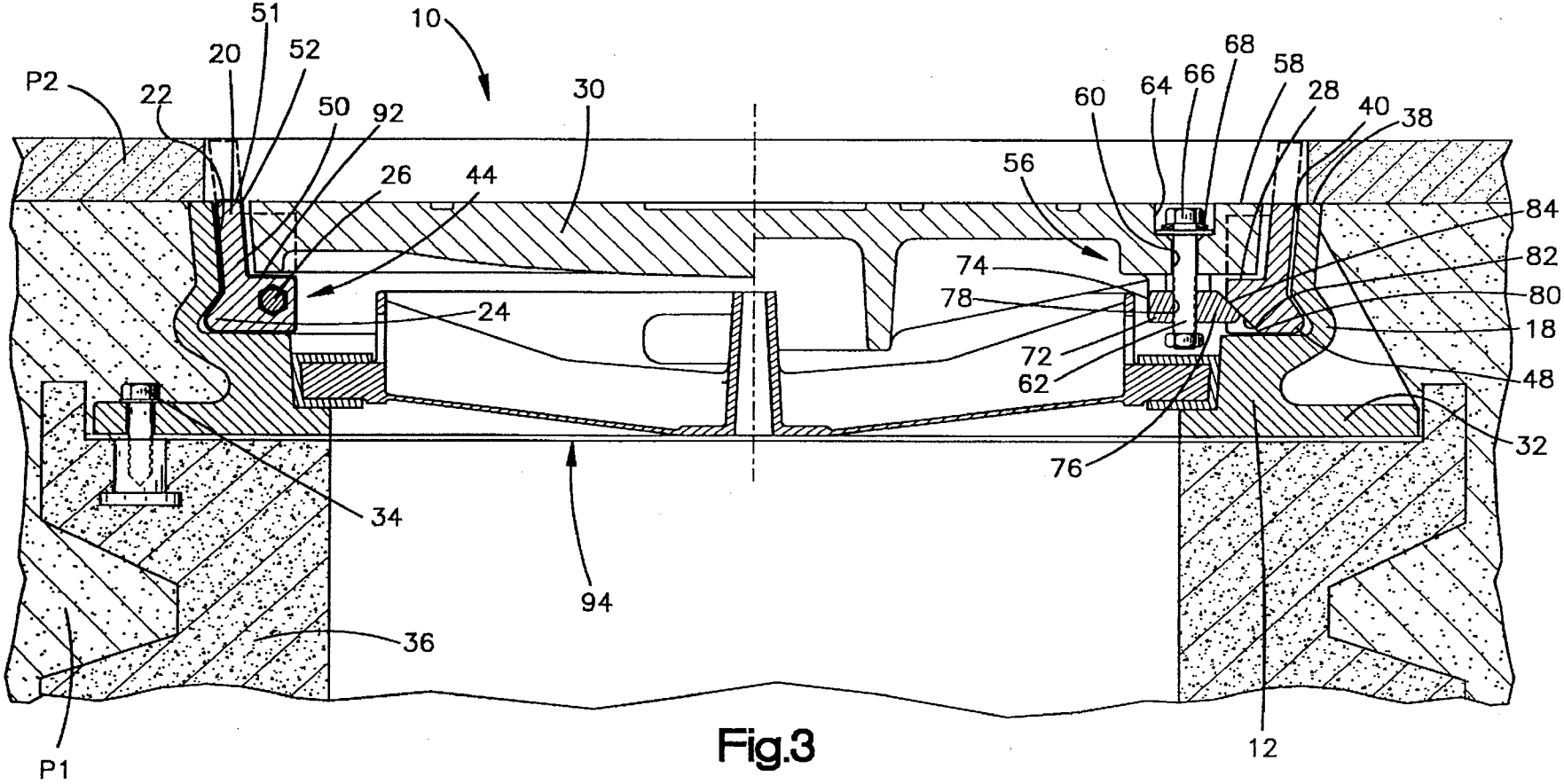
FIG. 3 is a vertical cross-sectional view as seen from the plane taken approximately along the lines 3—3 of FIG. 1, showing the manhole cover and frame assembly in a position in which it is originally installed and a repaved surface $P_2$ added to an original paved surface $P_1$.
Figure 4:
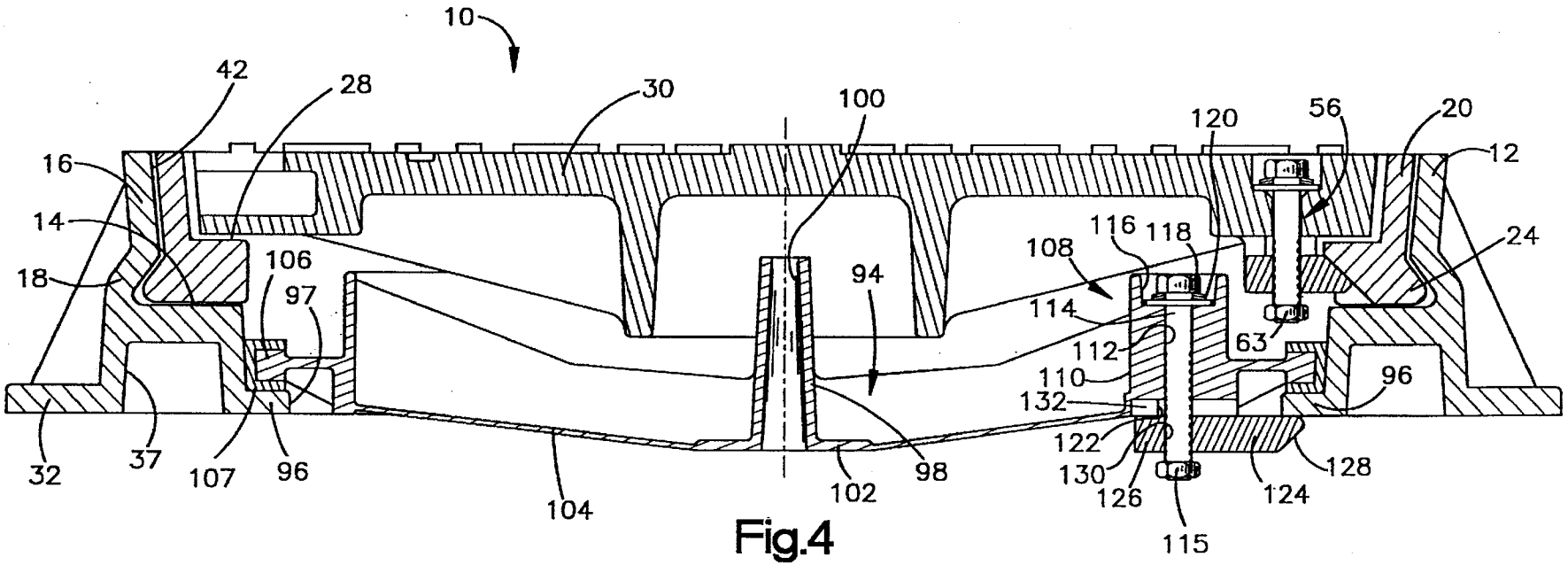
FIG. 4 is a vertical cross-sectional view of one embodiment of a fluid shield with a locking device constructed in accordance with the present invention.

Turning now to FIGS. 1, 3 and 4, the manhole cover and frame assembly of the invention is shown generally at 10. The manhole cover and frame assembly 10 includes an outer frame 12 having a support surface 14 and a side wall 16 extending upward from the support surface 14. The side wall 16 has a recessed portion 18. An inner frame 20 is supported on the support surface or shelf 14. The inner and outer frames 12, 20 are formed of cast ductile iron, for example ASTM type 536, grade 65-45-12.

The inner frame 20 includes four segments 20*a–d* each having an outer peripheral surface 22 and a protrusion 24 extending from the outer peripheral surface 22. Turnbuckles 26 connect adjacent segments 20*a*–20*d*. By adjusting the turnbuckles 26 the inner frame 20 can expand to move each protrusion 24 into the recessed portion 18, and contract to remove each protrusion 24 from the recessed portion 18. The inner frame 20 also includes a cover support surface 28, upon which a manhole cover 30 is supported. The cover 30 can be fastened to the inner frame 20 using locking devices 56. The cover 30 can be constructed to conform to U.S. standards, as well as to other standards, such as the Japanese Industrial Standard (JIS) A 5506, Manhole Covers for Sewerage.

The outer frame 12 has a base portion 32 anchored with fasteners 34 to a manhole casement structure 36 usually formed of concrete that provides access to a utility service such as sanitary sewer distribution lines. As shown in FIG. 4, the outer frame 12 can have an annular groove 37 at its bottom surface. The groove 37 reduces the weight of the outer frame 12. The groove 37 fits onto an annular protrusion (not shown) formed on the top surface of the casement structure 36. A sealing gasket (not shown) formed of rubber, for example, may be connected to the outer frame 12 to provide a fluid seal between the casement structure 36 and the outer frame 12. The casement structure 36 can be constructed to conform to U.S. standards, as well as to other standards, such as the Japanese Industrial Standard (JIS) A 5317, *Reinforced Concrete Manhole Blocks for Sewerage Work.*

The support surface 14 of the outer frame 12 is a shelf that extends substantially horizontally inwardly from the side wall 16 and is integrally formed with the base 32. The side wall 16 extends upwardly from the shelf 14 to a top rim 38. A portion of an inner peripheral surface 40 of the outer frame 12 adjacent the top rim 38 defines an access opening 42.

The side wall 16 and shelf 14 form a housing 44 for the inner frame 20. As a result of fabrication, the side wall 16 of the outer frame 12 may slope slightly upwardly and outwardly from the shelf 14 to the top rim 38. Above the shelf 14 the side wall 16 has a recessed or uncut portion 18 that extends downwardly and outwardly to an intersection with the shelf 14. The recessed portion 18 may be formed by cutting a recess into the side wall 16 or by providing the side wall 16 with a configuration to form an uncut portion as shown in FIG. 3.

The angle of the inner peripheral surface 40 at the recessed portion 18 can range from an angle of about 1. degree less than the normal to the shelf 14 to an angle of about 1 degree above the plane of the shelf 14. However, it will be understood from the instant disclosure that the recessed portion 18 can have any configuration that prevents the protrusion 24 of the inner frame 20 from being lifted from the recessed portion 18.

As shown in FIGS. 1, 3 and 4, the inner frame 20 fits into the housing 44 and is seated on the support surface 14. Each of the adjacent segments, e.g., **20*b* and 20*c*, are connected by a turnbuckle 26. Each of the segments 20*a*–20*d* has a base 48 and a side wall 50 extending upward from the base 48 to form an opening 52 defined by a rim 51 at an upper portion thereof. The side walls 50 may be fabricated to be sloped outwardly from the base 48 to the rim 51. The cover 30 is placed in the opening 52 and supported on a peripheral cover support surface 28 of the inner frame member 20**.

The diameter of the opening 52 is adjustable by adjusting the turnbuckles 26 to expand or contract the inner frame 20 in the lateral direction. The protrusion 24 is configured to fit into the recessed portion 18. By adjusting the turnbuckles 26 to expand the inner frame 20, the protrusion 24 of the inner frame 20 is releasably moved into engagement with the recessed portion 18 of the outer frame 12. Once the protrusion 24 is positioned in the recessed portion 18, the inner frame 20 is prevented from substantial movement and removal from the access opening 42.

Figure 2:
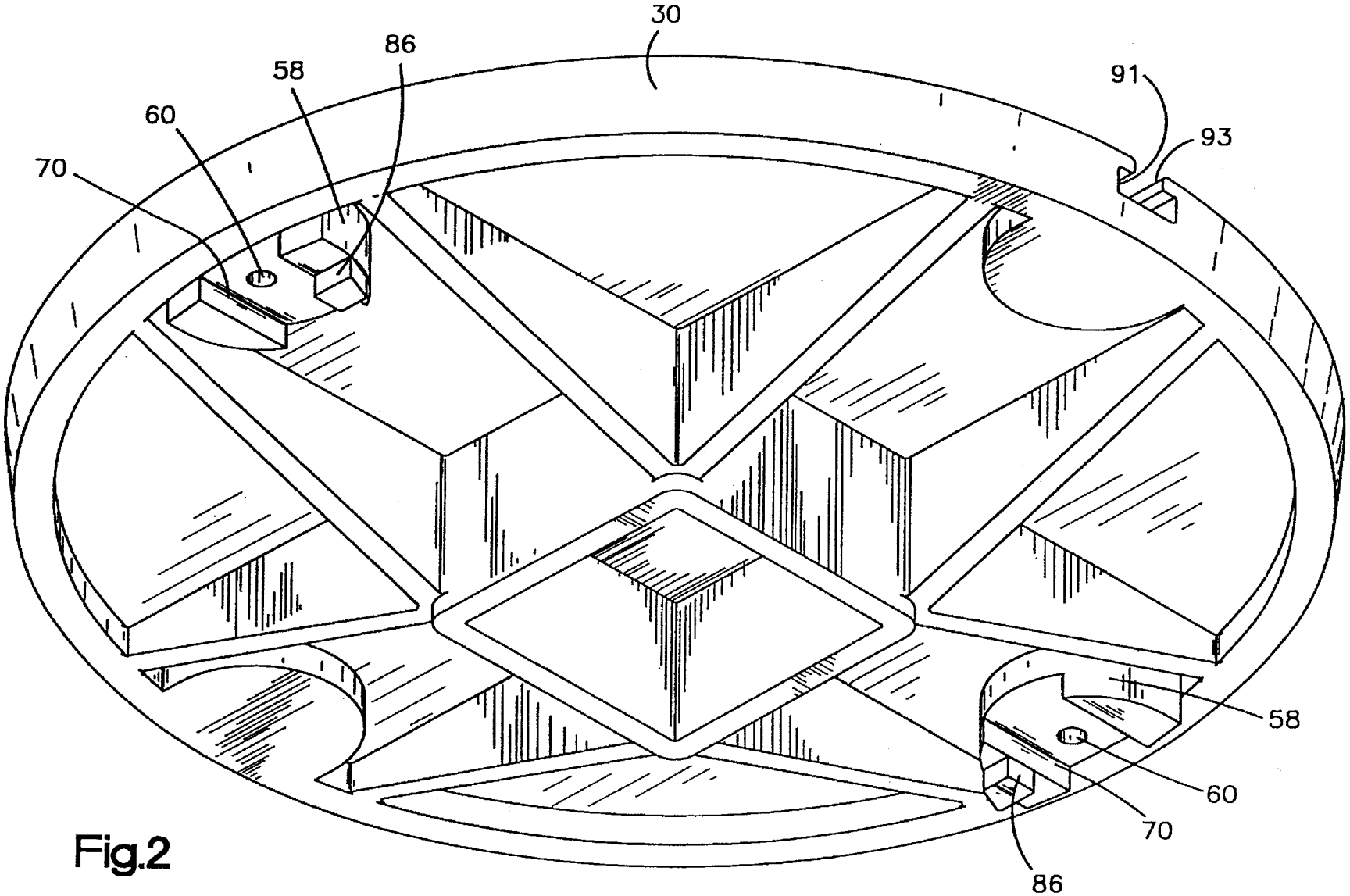
FIG. 2 is a perspective view of the bottom of the manhole cover shown in FIG. 1.

Each of the locking devices 56 is preferably of the type disclosed in U.S. Ser. No. 08/242,015 to Bowman, which is incorporated herein by reference in its entirety. Although two locking devices are shown, more locking devices could be used. Each locking device 56 includes a housing 58 integrally formed with the cover 30 and having a threaded portion defining a vertical bore 60. A threaded bolt 62 is fitted into each bore 60 with sufficient clearance to permit the bolt 62 to rotate. A recess 64 is formed at the top of each housing 58 to accommodate the heads 66 of the bolts 62. A lock washer or Belleville-type spring disk 68 is placed between the head 66 of the bolt 62 and the bottom of the recess 64 to resist loosening of the bolt 62 once it is tightened. A nut 63 may be provided at the bottom of the bolt 62. Radially extending slots 70 are formed at the bottom of the housing 58, as shown in FIG. 2.

As shown in FIG. 3, each locking device 56 has a locking member 72 with a heel portion 74 and a toe portion 76, and a threaded portion defining a bore 78 therethrough. The bore 78 is sized to fit the threaded shaft of the bolt 62. At least two of the segments, eg., **20*b* and 20*d*, have undercut portions 80 as best shown in FIG. 3. Each locking member 72 is configured to fit into one of these undercut portions 80 upon being rotated, and to engage the inner frame 20. The top of each of the undercut portions 80 has an outwardly sloping surface 82. The toe portions 76 of each locking member 72 are each bevelled to have an outwardly sloping surface 84 that corresponds to the slope of the associated undercut sloping surface 82**.

Each heel 74 of the locking member 72 is arranged to be able to engage a stop member 86 that is adjacent the slot 70. The housings 58 not only provide stop surfaces for the locking members 72, but also serve to protect the threads of the bolts 62 and the locking members 72 themselves from damage caused by pry bars and other tools used around manholes. When the locking members 72 are in a neutral position N in FIG. 1, the cover 30 may be placed inside the inner frame 20 without interference from the locking members 72.

If each locking member 72 is in its inner neutral position N, rotation of the bolt 62 in a clockwise direction (in FIG. 1) will cause the toe portion 76 to rotate clockwise into its locking position L. In the locking position L the locking member 72 is engaged in the undercut portion 80. The locking member 72 will not be permitted to rotate further when the heel 74 engages the stop member 86.

Further rotation of the bolt 62 in the clockwise direction will cause the locking member 72 to move axially upward along the bolt 62 in the slot 70 due to the relative configurations of the threads formed on the outside of the bolt 62 and in the housing along the bore 60. During this time, the slot 70 maintains the locking member 72 in the locking position L. Tightening of the bolt 62 eventually causes the sloping surfaces 84, 82 of the locking member 72 and undercut portions 80, respectively, into contact each other. This locks the cover 30 to the inner frame 20.

By rotating the bolt 62 in the opposite direction (counterclockwise as viewed in FIG. 1) when the cover 30 is locked to the inner frame 20, the locking member 72 moves downward along the bolt 62 within the slot 70 until it is free from the inner frame 20. Without the frictional drag of engagement with the inner frame 20 and once the locking member 72 is lowered out of the slot 70, the locking member 72 will rotate inward (counterclockwise as viewed in FIG. 1) until it has again reached the neutral position N. The locking member 72 advantageously engages the stop member 86 in both the locking position L and neutral position N.

To install the manhole cover and frame assembly 10, the turnbuckles 26 of the inner frame 20 are adjusted in one direction to contract the inner frame 20 and reduce its diameter. The diameter of the inner frame 20 is reduced until the inner frame 20 can be seated on the outer shelf 14 without interference from the protrusion 24. Once the inner frame 20 is seated, the turnbuckles 26 are adjusted in the other direction to expand the inner frame 20 and increase its diameter so that the protrusion 24 engages the recessed portion 18 of the outer frame 12. This locks the inner and outer frames together and prevents substantial upward lifting of the inner frame 20.

The locking members 72 are rotated to a neutral position N so that they will not interfere with seating of the cover 30.

Then, the cover 30 is aligned with the access opening 42. The cover 30 has diametrically opposed openings 93 each leading to a groove 91. A tool such as a spanner wrench is inserted through the openings 93 in the cover 30 into the grooves 91. Using the tool, the cover 30 is rested on the cover support surface 28 and rotated until an indicator mark 88 on the cover 30 is aligned with an indicator mark 90 on the rim 51 of the inner frame 20. This indicates that the cover 30 is in a proper circumferential position to align each of the locking devices 56 carried by the cover 30 with an associated undercut portion 80 of the inner frame 20. Then, a worker rotates the heads 66 of the bolts 62 clockwise (as viewed in FIG. 1) to move the locking members 72 into locking positions L in their associated recessed portions 18. The bolts 62 are further rotated in a clockwise direction to raise each locking member 72 into engagement with the underside of the inner frame 20 and to compress each Belleville spring.

Turning to FIG. 3, when a roadway is resurfaced, a layer of additional paving material P2 is laid atop the original roadway $P_1$. As a result, the overall level or grade of the roadway is raised. An inner frame insert 20 shown in dotted lines, which has a longer side wall 50 and a higher cover support surface 28 than the insert 20 shown in solid lines at the level of the original roadway $P_1$, is selected such that the original manhole cover 30 is flush with the new roadway level $P_2$. This inner frame insert 20 shown in dotted lines replaces the inner frame 20 shown in solid lines. The other features of the inner frame insert 20 are the same as discussed above.

A seal 92, shown for illustrative purposes on only the left side of the inner frame 20 in FIG. 3, is preferably provided between the inner and outer frames 12, 20 to prevent inflow from passing therebetween. Preferably, the entire inner frame 20 is covered with the sealant material to form the seal 92. However, the seal 92 could be provided on the outer frame member 12. Any compressible sealant material may be used for the seal 92, although natural rubber is preferred.

A detailed list of materials that may be suitable for the seal 92 between the outer and inner frames 12, 20, as well as for all other seals of the present invention, is provided in U.S. Pat. Nos. 4,969,771 and 4,927,290 to Bowman, which are incorporated herein by reference in their entirety. These materials are preferably selected to withstand the periodic stresses exerted on them when the cover 30 is rotated on the inner frame 20. It should be noted that some of the materials, such as closed cell foam, may be unable to withstand such periodic stresses.

The inner frame 20 can advantageously be provided with a water-tight plug (not shown) that fits into the space or spaces 89 existing between the segments 20*a*–20*d* of the inner frame 20 after installation. A molded portion or a portion of an extruded member cut to fit, can be heated or chemically bonded in place to keep the inner frame 20 water-tight. These plugs identify the placement of the turnbuckles 26 and can be molded or otherwise formed to cover the turnbuckles 26.

For a description of these plugs and of the materials from which they can be formed, see the 4,927,290 patent. In particular, the plugs 36 referred to in the 4,927,290 patent correspond to those of the present invention. In the invention, the plugs can also be formed of any of the sealant materials referred to in the 4,969,771 and 4,927,290 patents.

Another way the present invention prevents inflow from entering the utility service is by providing a fluid barrier or shield 94, one preferred embodiment of which is shown in FIGS. 3 and 4. The fluid shield 94 is preferably made of aluminum or plastic. The shield 94 is positioned below the cover 30 for catching fluid passing the cover 30. The outer frame 12 includes a laterally extending lower flange 96 that defines a flange opening 97. The shield 94 is supported on the flange 96.

The shield 94 shown in FIGS. 3 and 4 includes a central hub 98 with a passage 100 therethrough and a lower base portion 102. A portion 104 extends laterally from the base portion 102 toward the flange 96. The outer configuration of the central hub 98 has a narrowing taper upward from the lower base portion 102. The lateral portion 104 is sloped downward from an outer peripheral rim 106 to the central hub 98. The configurations of the sloped lateral portion 104 and the tapered hub 98 serve to catch any inflow that passes the cover 30 and prevent it from entering the utility service. The hub passage 100 is provided to release pressure that may build up in the utility service.

A seal 107 is provided between the shield 94 and the flange 96. The seal 107 is preferably a sealant material attached or bonded to the shield 94. Suitable sealant materials for the seal 107 are described in the 4,969,771 and 4,927,290 patents. The seal 107 is preferably configured by forming a natural rubber material into a tubular shape and adhering the material to the rim 106 of the fluid shield 94.

As shown in FIG. 4, the shield 94 may also include a locking device 108 for sealingly connecting the shield 94 to the outer frame 12. This locking device 108 is similar to that discussed above for the manhole cover 30. Each locking device 108 includes a housing 110 integrally formed with the shield 94. The housing 110 has a vertical bore 112 therein. A threaded bolt 114 is fitted into each bore 112 with sufficient clearance to permit the bolt 114 to rotate. A recess 116 is formed at the top of each housing 110 to accommodate heads 118 of the bolts 114. A lock washer or Belleville-type spring disk 120 is placed between the head 118 of each bolt 114 and the bottom of the recess 116 to resist loosening of the bolt 114 once it is tightened. A nut 115 may be provided at the bottom of the bolt 114. Radially extending slots 122 are formed at the bottom of the housing 110, as shown in FIG. 4.

Each locking device 108 has a locking member 124 with a heel portion 126 and a toe portion 128. Each locking member 124 also has a threaded portion defining a vertical bore 130 through the locking member. The bore 130 is sized to fit the threaded shaft of the bolt 114. Each locking member 124 is configured so that a top surface of the locking member engages the lower surface of the flange 96 upon rotating the locking member into locking position.

The heel 126 of the locking member 124 is arranged to engage a stop surface 132 which is the edge of the slot 122 extending vertically through the wall of the housing 110. When the locking members 124 are in a neutral position, i.e., extending perpendicular to the page (rotated 90 degrees from the position shown in FIG. 4), the fluid shield 94 may be placed inside the outer frame 12 without interference from the locking members 124.

When the locking members 124 are in an inner neutral position they extend substantially perpendicular to the position shown in FIG. 4. Rotation of the bolt 124 in one direction will cause the toe portion 128 to rotate in a direction out of the page (in FIG. 4) into its outer locking position shown in FIG. 4 where the toe portion 128 extends outside the perimeter of the flange opening 97. The locking member 124 will not be permitted to rotate further when the heel 126 engages the stop surface 132.

Further rotation of the bolt 114 in the same direction causes the locking member 124 to move axially upward along the bolt 114 in the slot 122 due to the relative configuration of the threads formed on the outside of the bolt 114 and the inside of the bore 112. The locking member 124 is confined by the slot 122 in the locking position. Tightening of the bolt 114 eventually causes the top surface of the toe portion 128 to engage the underside of the flange 96, which locks the shield 94 to the outer frame 12.

By rotating the bolt 114 in the opposite direction when the shield 94 is connected to the outer frame 12, the locking member 124 moves downward along the bolt 114 in the slot 122 until it is free from the flange 96. Without the frictional drag of engagement with the flange 96 and when it is lowered out of the slot 122, the toe portion 128 of the locking member 124 will rotate in a direction into the page (in FIG. 4) until it has again reached a neutral position within the flange opening 97 in which the locking member 124 engages the stop surface 132. The locking member 124 advantageously engages the stop surface 132 when it is in both the locking and neutral positions.

Figure 5:
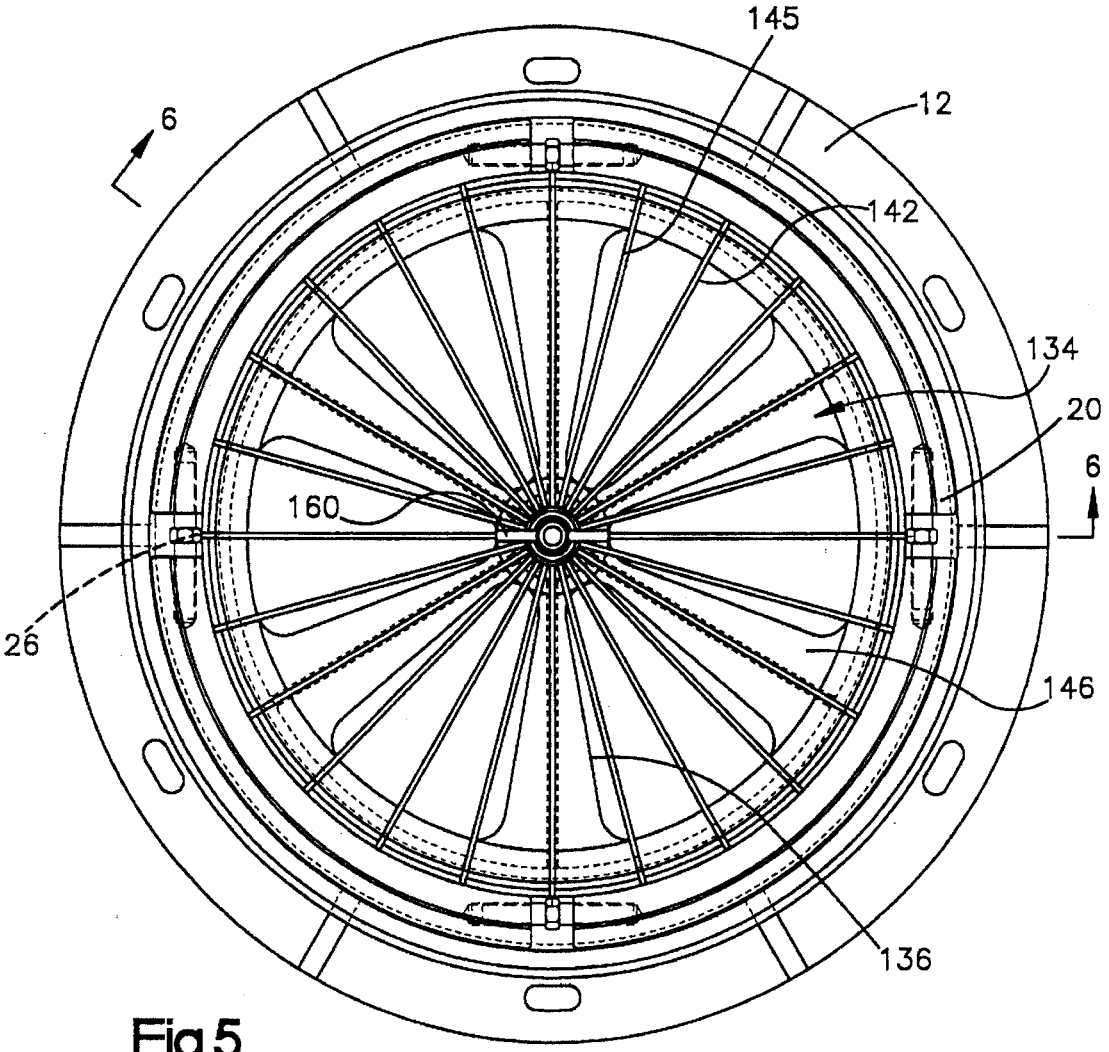
FIG. 5 is a top plan view showing another embodiment of the fluid shield of the invention.
Figure 6:
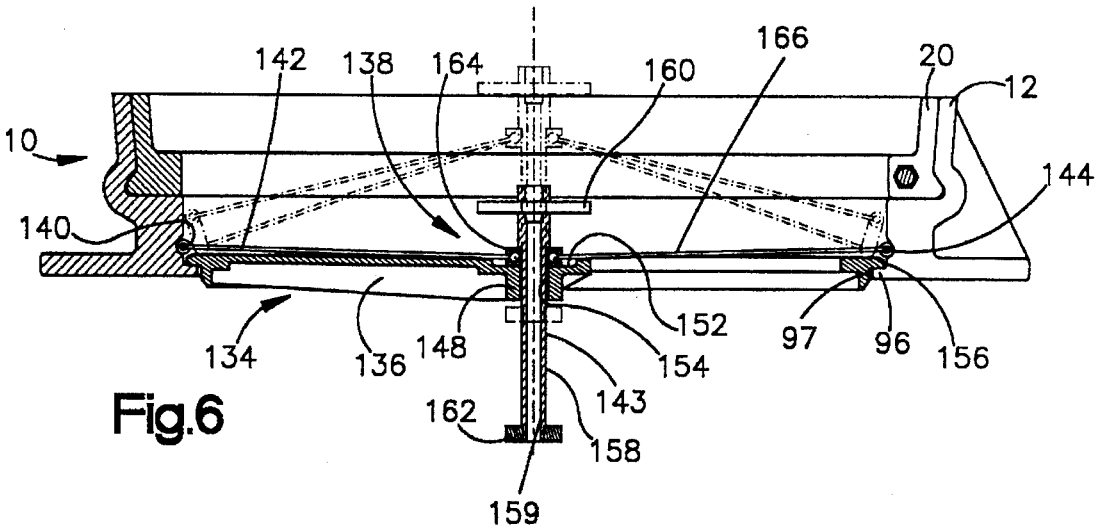
FIG. 6 is a vertical cross-sectional view as seen from the plane taken approximately along the lines 6—6 in FIG. 5.

Another more preferable embodiment of a fluid shield 134 of the invention is shown in FIGS. 5 and 6. The shield 134 includes a rigid spider member 136 and an apparatus 138 for sealingly connecting the spider member 136 to the outer frame 12. A peripheral groove 140 is formed in the outer frame 12 above the lower flange 96.

The connecting apparatus 138 includes a plunger 143 and a flexible member 142 normally having an accordion-like cross-sectional shape. The flexible member 142 is preferably formed of plastic material having radially extending creases 145 as shown in FIG. 5. The flexible member 142' has an inner portion 166, which is located around the stop portion 164. The flexible member 142 preferably has a seal 144 attached to its outer periphery. Any of the sealant materials disclosed in the 4,969,771 and 4,927,290 patents may be used for this seal 144, although a rubber material is preferred.

As shown in FIG. 5, the spider member 136 has a plurality of spokes 146 extending from a central portion 148 to the outer periphery of the spider member 136. As shown in FIG. 6, the spider member 136 has a shoulder portion 156 that is seated on the flange 96. The central portion 148 has an annular depression 152 and a hole 154 that begins at the depression 152 and extends vertically through the central portion 148.

The plunger 143 includes a body portion 158 that is axially movable in the central hole 154 of the spider member 136 and includes a passage 159 therethrough for permitting inflow to pass into the utility service lines. A handle 160 formed for example by washers is disposed at one end portion of the spider member 136 and a lower stop member such as a nut 162 is disposed at the other end. The flexible member 142 is connected to the plunger 143 at a stop portion 164 on the plunger 143, which limits the downward axial movement of the plunger 143. When the plunger 143 is depressed so that the stop portion 164 is moved into the depression 152 and engages the spider central portion 148, the plunger cannot be moved further in the downward axial direction. The lower stop member 162 prevents the plunger 143 from being lifted upward out of the central hole 154, and also assists in insertion and removal of the fluid shield 134 with respect to the flange 96.

The shield 134 is sealingly connected to the outer frame 12 in the following manner. A workman holds the handle 160 so that the bottom of the spider member 136 is supported by the lower stop member 162. In this manner the spider member 136 is placed onto the flange 96 so that the shoulder 156 is seated on the flange 96 and the periphery of the flexible member 142 is disposed adjacent the groove 140. In this normal condition, the flexible member 142 has an accordion-like vertical cross-sectional shape due to the plastic bending at the creases 145, as shown by the dotted lines of FIG. 6.

The plunger 143 is then pushed downward, depressing the inner portion 166 of the flexible member 142 into the depression 152 and against the spider central portion 148. By moving the inner portion 166 of the flexible member 142 into the depression 152, a portion of the flexible member 142 between the plunger 143 and the groove 140 is sloped toward the plunger 143 below a horizontal plane parallel to the plane of the groove 140. By depressing the plunger 143 in this manner, the seal 144 at the periphery of the flexible member 142 is sealingly engaged in the peripheral groove 140 and prevents inflow from entering the flange opening 97. When in the sealed position, the flexible member 142 is flattened and preferably no longer has an accordion-like shape.

While preferred embodiments of this invention have been described in detail, it will be apparent that certain modifications or alterations can be made without departing from the spirit and scope of the invention set forth in the appended claims.

What is claimed is:

1. A manhole frame assembly comprising an outer frame member and an inner frame member that can be received by said outer frame member, said outer frame member having a support surface and a side wall that extends upwardly from the support surface, said side wall having a recessed portion that is at least partially defined by an abutment surface that prevents upward movement of said inner frame member, said inner frame member being supportable on said support surface and including (a) at least one protrusion extending from an outer peripheral surface of said inner frame member, (b) at least one adjustable joint adapted to adjust said inner frame member in its peripheral dimensions to expand to move said protrusion into said recessed portion, whereby said protrusion contacts said abutment surface to prevent upward movement of said inner frame member, and to contract to remove said protrusion from said recessed portion, and (c) a cover support surface for supporting a manhole cover.

2. The manhole frame assembly of claim 1 wherein said inner frame member comprises at least two segments and adjacent segments are connected by an adjustable member of said joint.

3. The manhole frame assembly of claim 2 wherein an expandable opening is located between each of said segments and a seal is provided in each said expandable opening.

4. The manhole frame assembly of claim 1 wherein said side wall extends outwardly from the support surface.

5. The manhole frame assembly of claim 1 further comprising a manhole cover supportable on said cover support surface.

6. The manhole frame assembly of claim 5 further comprising a fastener adapted to connect said cover to said inner frame member.

7. The manhole frame assembly of claim 5 further comprising a fluid shield member adapted to be positioned below said cover for catching fluid passing said cover.

8. The manhole frame assembly of claim 7 further comprising a fastener for connecting said fluid shield member to said outer frame member.

9. The manhole frame assembly of claim 1 further comprising a seal between said inner and outer frame members.

10. The manhole frame assembly of claim 1 wherein said outer frame member includes a groove in a lower surface thereof for receiving a seal between said outer frame member and a casement structure.

11. The manhole frame assembly of claim 1 wherein each said joint comprises a bolt structure disposed above said support surface of said outer frame member.

12. A manhole cover and frame assembly comprising an outer frame member having a support surface and a side wall that extends upwardly from the support surface and has a recessed portion, an inner frame member supportable on said support surface including (a) an outer peripheral surface and a cover support surface for supporting said cover, (b) an undercut portion disposed at a lower surface of said inner frame member and a protrusion extending from said outer peripheral surface, and (c) an adjustable member adapted to adjust said inner frame member in its peripheral dimensions to expand to move said protrusion into said recessed portion, thereby preventing upward movement of said inner frame member, and to contract to remove said protrusion from said recessed portion, a manhole cover adapted to be supported on said cover support surface, and an apparatus for connecting said cover to said inner frame member, comprising (a) rotatable locking members each having a heel portion and a toe portion, said toe portion being adapted to engage said undercut portion, and a threaded portion defining a hole therein, (b) threaded shafts each of which is located in an associated opening in said cover and is threaded to an associated one of said locking members, each of said shafts having a head portion for permitting said shaft to be rotated, and (c) stop surfaces disposed on said cover each being adapted to stop rotation of an associated said locking member at a predetermined position;

whereby rotation of each said shaft head portion causes said associated locking member to rotate until said toe portion of said associated locking member extends into said undercut portion of said inner frame member at a stopping point where said associated locking member engages its associated stop surface, and further rotation of said shaft drives said associated locking member toward said cover to clamp said cover to said inner frame member.

13. The manhole frame assembly of claim 12 wherein said inner frame member comprises at least two segments and adjacent segments are connected by said adjustable member.

14. The manhole cover and frame assembly of claim 12 further comprising a seal between said inner and outer frame members.

15. A fluid shield for catching fluid passing a manhole cover disposed in an opening of a manhole structure, comprising a body that substantially completely covers the manhole opening, said body including a central hub portion with a passage therethrough and an outer portion extending laterally outwardly from said hub portion to an outer peripheral portion, said outer peripheral portion being adapted to be supported by the manhole structure, wherein said hub portion extends to a height above said peripheral portion.

16. The fluid shield of claim 15 wherein said outer portion is sloped downwardly from said peripheral portion to said hub portion.

17. A fluid shield for catching fluid passing a manhole cover disposed in an opening of a manhole structure, comprising a rigid body portion having a central opening, a flexible member adjacent said body portion, said flexible member being adapted to substantially completely cover the manhole opening, and a plunger member axially movable in said central opening and connected to said flexible member, said plunger member being adapted to sealingly engage the periphery of said flexible member against the manhole structure.

18. The fluid shield of claim 17 wherein said plunger member includes stop members that can engage said body portion to limit the axial movement of said plunger.

19. The fluid shield of claim 17 wherein said flexible member has an accordion-like cross-sectional shape.

20. A manhole frame assembly comprising an outer frame member having a support surface and a side wall that extends upwardly from the support surface and has a recessed portion, said side wall having an upper surface that is adapted to be substantially flush with an original surrounding pavement surface, an inner frame member supportable on said support surface, including (a) at least one protrusion extending from an outer peripheral surface of said inner frame member, (b) at least one adjustable joint for adjusting said inner frame member in its peripheral dimensions to expand to move said protrusion into said recessed portion, thereby preventing upward movement of said inner frame member, and to contract to remove said protrusion from said recessed portion, (c) a cover support surface for supporting a manhole cover, and (d) a side wall that extends upwardly from said cover support surface, said side wall having an upper surface that can be adapted to be substantially flush with said upper surface of said outer frame side wall.

21. A manhole cover assembly comprising a manhole cover adapted to be supported on a support surface of a manhole frame structure, and an apparatus for connecting said cover to a manhole frame structure, comprising (a) rotatable locking members each having a heel portion, a toe portion and a threaded portion defining a hole therein, said toe portion being adapted to engage a portion of a manhole frame structure, (b) threaded shafts each of which is adapted to be located in an associated opening in said cover and is threaded to an associated one of said locking members, each of said shafts having a head portion for permitting said shaft to be rotated, and (c) stop surfaces disposed on said cover each being adapted to stop rotation of an associated said locking member at a predetermined position;

whereby rotation of each said shaft head portion causes said associated locking member to rotate until said toe portion of said associated locking member is positioned adjacent an abutment surface of a manhole frame structure at a stopping point where said associated locking member engages its associated stop surface, and further rotation of said shaft drives said associated locking member toward the abutment surface to clamp said cover to a manhole frame structure.

* * * * *